US009107476B2

(12) United States Patent
Kruglov

(10) Patent No.: US 9,107,476 B2
(45) Date of Patent: Aug. 18, 2015

(54) ADJUSTABLE SPRING DEVICE FOR WALKING AND RUNNING

(71) Applicant: Sergey V. Kruglov, Verdun (CA)

(72) Inventor: Sergey V. Kruglov, Verdun (CA)

( * ) Notice: Subject to any disclaimer, the term of this patent is extended or adjusted under 35 U.S.C. 154(b) by 289 days.

(21) Appl. No.: 13/727,064

(22) Filed: Dec. 26, 2012

(65) Prior Publication Data

US 2014/0173931 A1 Jun. 26, 2014

(51) Int. Cl.
*A43B 13/18* (2006.01)

(52) U.S. Cl.
CPC ..... *A43B 13/183* (2013.01); *A43B 13/184* (2013.01)

(58) Field of Classification Search
CPC .... A43B 13/18; A43B 13/181; A43B 13/182; A43B 13/183; A43B 13/185; A43B 13/146
USPC ..... 36/7.8, 25 R, 27, 28, 29, 31, 35 R; 482/75, 77, 79, 80
See application file for complete search history.

(56) References Cited

U.S. PATENT DOCUMENTS

| | | | | |
|---|---|---|---|---|
| 1,638,350 | A * | 8/1927 | Long | 36/7.8 |
| 4,309,832 | A * | 1/1982 | Hunt | 36/32 R |
| 6,318,001 | B1 * | 11/2001 | Lee | 36/27 |
| 6,574,889 | B2 * | 6/2003 | Cagner | 36/102 |
| 7,334,351 | B2 * | 2/2008 | Hann | 36/27 |
| 7,779,558 | B2 * | 8/2010 | Nishiwaki | 36/27 |
| 8,650,774 | B2 * | 2/2014 | Aveni et al. | 36/27 |
| 2009/0205224 | A1 * | 8/2009 | Rosenbaum | 36/25 R |
| 2012/0115687 | A1 * | 5/2012 | Kruglov | 482/77 |

OTHER PUBLICATIONS

"compressed,adj." Merriam-Webster.com. Apr. 2015. Web. Apr. 9, 2015. http://www.merriam-webster.com/dictionary/compressed.*
"bend,t. verb" Merriam-Webster.com. Apr. 2015. Web. Apr. 9, 2015. http://www.merriam-webster.com/dictionary/bend.*

* cited by examiner

*Primary Examiner* — Richale Quinn
*Assistant Examiner* — Anne Kozak
(74) *Attorney, Agent, or Firm* — Aleksandr Smushkovich

(57) ABSTRACT

An adjustable spring device for Walking and running is attachable to the user's footwear. The device includes an upper sole coupled to the footwear, a lower elastic sole, and a support bracket configured as a curvilinear confined band that includes a flat top fastened to the upper sole, and a concaved bottom fastened to the lower sole. The lower sole is furnished with a plurality of slots, preferably straight-lined, and aligned at a predetermined angle, cut from the periphery towards the longitudinal axis of lower sole and ending at predetermined points thereof. The slots are preferably so arranged that, if the predetermined points are linked by four straight lines extending therethrough, the four lines will form a rhomb-shaped figure having two vertexes positioned at the front and the rear ends of the lower sole. Means for variable adjustment of the support bracket are provided, creating comfortable energy exchange conditions.

1 Claim, 5 Drawing Sheets

ADJUSTABLE SPRING DEVICE FOR WALKING AND RUNNING

CROSS-REFERENCE TO RELATED APPLICATIONS

This application is a continuation-in-part application of a co-pending U.S. nonprovisional application Ser. No. 13/374,028 filed on 8 Dec. 2011, which, in turn, is a continuation-in-part application of a U.S. nonprovisional application Ser. No. 12/925,127 filed on 15 Oct. 2010, now abandoned. The disclosures of application Ser. Nos. 13/374,028 and 12/925,127 are hereby incorporated by reference in their entirety.

FIELD OF THE INVENTION

The invention relates to devices intended to supplement footwear and facilitate walking and running of users of the footwear. It can be utilized for exercising, rehabilitation, entertainment, and other activities.

BACKGROUND OF THE INVENTION

It is well known that the center of mass of a person completes vertical motions with each step when the person runs or walks. During each step the person lifts himself up for a few centimeters, spends certain energy, and loses the most portion thereof without return.

The main purpose of a typical footwear-supplementing device, which has an elastic system, is the conservation and returning the kinetic energy to the user and also the reduction of shock loads on the user's leg joints and spine.

The effectiveness of such a device depends on an optimal condition of the energy exchange between the device and the user in locomotion. This optimal condition exists when the inert forces are balanced with the elastic forces, which results in that the energy exchange between the user and the device is most efficient. This is known as a resonance phenomenon. However, the condition of resonance depends on each user's individual characteristics. If this device works well for one user, it does not necessarily mean that the device will work for another user as well. This is a serious disadvantage of such devices.

The instant invention is based on the concept that the design of a footwear-supplementing device has to consider the device itself and the user with his/her individual characteristics as a whole, i.e. as one common system. An individual setup or adjustment of the device needs to be applied to each user.

The known solutions do not usually take into consideration the aforementioned condition of resonance. Typical devices of this kind are taught, for example, in the following U.S. patents:

| | |
|---|---|
| 75,900 | Hale and Hubbell (1868) |
| 871,864 | Feazell and Thompson (1907) |
| 1,587,749 | Bierly (1926) |
| 4,360,978 | Simpkins (1982) |
| 4,534,124 | Schnell (1985) |
| 5,343,636 | Sabol (1994) |

However, the above-mentioned devices are not adjustable for a variety of users with different weight and manner of motion.

There is known a U.S. Pat. No. 6,436,012 issued to Naville (2002). Naville's device has an intermediate section composed of separate non-simple parts in order to adjust the resistance of the intermediate section according to the weight of a user. It however requires the availability of the parts for the intermediate section that increases the cost of the device. Besides, if these parts are metal springs, it will increase the weight of the device. Moreover, Naville's device is not adjustable to the manner of locomotion of a particular user. As a result, the user will have to adapt to the device, which is usually inconvenient. The opposite way is preferred, i.e. the device should be adjusted for the user.

There are also known U.S. Pat. No. 6,283,897 to Patton, U.S. Pat. No. 6,955,616 to Barth, and U.S. Pat. No. 7,736,285 to Brown. The elastic systems taught in those patents are based on elastomeric (e.g. 'means for elastomeric tethering' taught in Barth) or stretchable (e.g. 'a first stretchable member' and 'a second stretchable member' taught in Brown) members having a variable length (that create a resistance during exercises, e.g. 'elastomeric resistance members such as surgical tubings' taught in Patton), whereas the instant invention has no such stretchable members, but instead uses flexible members with a constant length that limit displacement of certain other device members.

Thus the mentioned related art devices have at least two problems:

1. The resonance phenomenon is not considered in the design and operation of the aforesaid devices. Therefore, those devices do not work optimally.
2. Every person has his/her unique condition of resonance. This condition is not addressed in the aforesaid devices.

It should also be taking into consideration that the resonance condition causes difficulties in the development of a commercially viable footwear-supplementing device.

The above indicated problems are partially solved in the aforesaid co-pending U.S. nonprovisional application Ser. No. 13/374,028 filed by the instant inventor. It provides an adjustable spring device for walking and running attachable to user's footwear, creating comfortable conditions during the locomotion. In embodiments, it includes: an upper lever and lower lever locating one above the other, wherein at least one of the levers is made of elastic material, and a support mechanism having a joint shaft that allows the levers to be pivoting. The device includes a first flexible link connecting the front ends of the levers, and a second flexible link connecting the rear ends of the levers. The links can be adjusted to a certain constant length before the deployment of the device. The device can be adapted by shifting the support mechanism between the levers and by adjusting the flexible links between the lever ends. However, the aforementioned device is complicated in manufacturing and use.

OBJECTS, BRIEF DESCRIPTION AND SUMMARY OF THE INVENTION

In order to provide comfortable resonant conditions for running or walking, the device should operate in a resonance mode, should have a capability of adjusting to a particular user and a capability to protect a user's joints while he/she is walking or running.

Therefore, an object of the present invention is the designing of a simple device that is capable of operating in the resonance mode. This provides favorable conditions for an energy exchange between the device and the user in order to move with greater ease and comfort.

Another object of this invention is to provide an opportunity for adjustment of the inventive device to the user's pattern of locomotion.

Another object of this invention is to develop an efficient device for protecting human joints and creating comfortable conditions of walking and running.

Other objects of the invention can be identified by a person skilled in the art upon learning the present disclosure. Without further analysis, the present disclosure will so fully reveal the gist of the invention that others can, by applying current knowledge, readily adapt it for various applications without omitting features that, from the standpoint of prior art, fairly constitutes essential characteristics of the generic or specific aspects of this invention.

There are three styles of movement, respectively, when a person puts his/her foot down on the ground with a rearfoot, midfoot, or forefoot strike (or load). In most cases, people use the rearfoot style. The pattern of locomotion determines a comfortable length of a person's step and a favorable speed of the person without any device.

It is known that running may include two phases: a phase of support (support phase) when the foot is in contact with the ground, and a transport phase when both the feet are off the ground. When a person walks, there is no transport phase so he/she only has the support phase. The duration of the support phase is very important, because it determines the condition of interaction between the device and the person.

A user and the footwear-supplementing device jointly create a common elastic system. Any elastic system is characterized by a natural oscillation period (frequency). If the oscillation period of the common elastic system is greater than the duration of the support phase, then the device is unable to transmit all of the energy stored in the system to the user.

If the oscillation period is less than the duration of support phase, then the device is unable to absorb all energy from the user. If the oscillation period is essentially equal to the duration of support phase then the device is capable of absorbing and returning the most possible energy from and to the user respectively. In such a case, the energy exchange between the device and the user in locomotion is most efficient.

The condition of resonance is fulfilled when the oscillation period of the aforesaid joint elastic system is equal to the duration of the support phase that is calculated under the following conditions: the comfortable length of the step and the favorable speed for the user without any device.

Currently walking and running are the most popular physical activities. It's generally known that walking and running can be viewed as a series of impacts with the ground. During the running, the impact forces higher than those during the walking. Even during normal walking, the forces are greater than the user's body weight. Thusly, the user's joints may sometimes experience significant injuries during these activities. All the above factors are taking into consideration in the instant invention.

The inventive adjustable spring device for walking and running is attached to the footwear and provides the user with a spring action during his/her movement on the ground. The inventive device encompasses an elastic system that absorbs, stores, and returns the kinetic energy accumulated during the gait cycle. The device can be adjusted for specific user needs according to the user's bodymass and a unique manner of locomotion of the particular user.

The inventive adjustable spring device for walking and running can be attached to or integrated into a user's footwear, creating comfortable conditions during the locomotion. In preferred embodiments, the inventive device comprises: an upper sole coupled to the footwear, the upper sole has a front end (herein called an 'upper front end'); and a rear end (herein called an 'upper rear end'); a lower sole situated below the upper sole, the lower sole has a front end (herein called a 'lower front end') and a rear end (herein called a 'lower rear end'); a support bracket (may also be called a 'support base') preferably configured as a curvilined confined band with a cross-section capable of approximating to a horizontally positioned '0'-like shaped figure, the support bracket has a flat top (i.e. an upper portion of the support bracket), a concaved bottom (i.e. a lower portion of the support bracket) slightly inwardly depressed (in the upward direction), and two lateral (preferably, arc-shaped) sides joined with the flat top and the concaved bottom, wherein the flat top is tightly fitted and fixedly fastened to the upper sole, whereas the concaved bottom is fastened to the lower sole; wherein the lower sole has a central longitudinal axis, a periphery; the lower sole is furnished with a plurality of slots (that can be straight or curvilined) each aligned at an angle to the central longitudinal axis (preferably a 90 degree angle), wherein each such slot is cut from the periphery towards the central longitudinal axis and ending at a predetermined point of the lower sole. The lower front end is located on the central longitudinal axis and on the periphery at the very front point of the lower sole. The lower rear end is located on the central longitudinal axis and on the periphery at the very rear point of the lower sole.

The upper sole should be made of predeterminedly stiff material that has minimum deformation upon applying a load developed during the user's walking/running. The lower sole should be fabricated from a suitable high-tensile (high-strength) material with a predetermined elasticity, such as a composite material, e.g. carbon fiber, or fiberglass, or a similar one. The underside of the lower sole can be covered by a layer (not shown herein) made of material suitable for efficient contact with the ground. The support bracket should be made of material possessing a sufficient strength to sustain extreme loads that might be developed during the user's walking/running.

For creating comfortable energy exchange conditions between the device and the user, and reducing the shock loads on the user's leg joints and spine, the device can be adjusted by shifting the support base between the upper and lower soles towards either the front ends or the rear ends of the soles. For this purpose the upper and lower soles, as well as the top and bottom of the support bracket are supplied with a plurality of orifices receiving bolts (or optionally, screws, pins, or similar 'male-shaped' fasteners) capable of coupling with corresponding threaded nuts (or similar 'female shaped' fasteners) thereby fixing the support bracket in a desirable position in relation to the front and rear ends of the soles.

According to the instant inventor's discovery, an optimal energy exchange condition can be established if the aforesaid slots are arranged forming a special pattern, wherein the aforesaid predetermined points of the lower sole are so disposed that, if linked by four straight lines extending through the aforesaid predetermined points, the four straight lines will form a rhomb-shaped figure having two vertexes essentially positioned on the periphery and on the central longitudinal axis at the lower front end and at the lower rear end respectively.

DETAILED DESCRIPTION OF PREFERRED EMBODIMENTS OF THE INVENTION

While the invention may be susceptible to embodiment in different forms, there are described in detail herein below, specific embodiments of the present invention, with the understanding that the present disclosure is to be considered an exemplification of the principles of the invention, and is not intended to limit the invention to that as illustrated and described herein.

Figure 1:
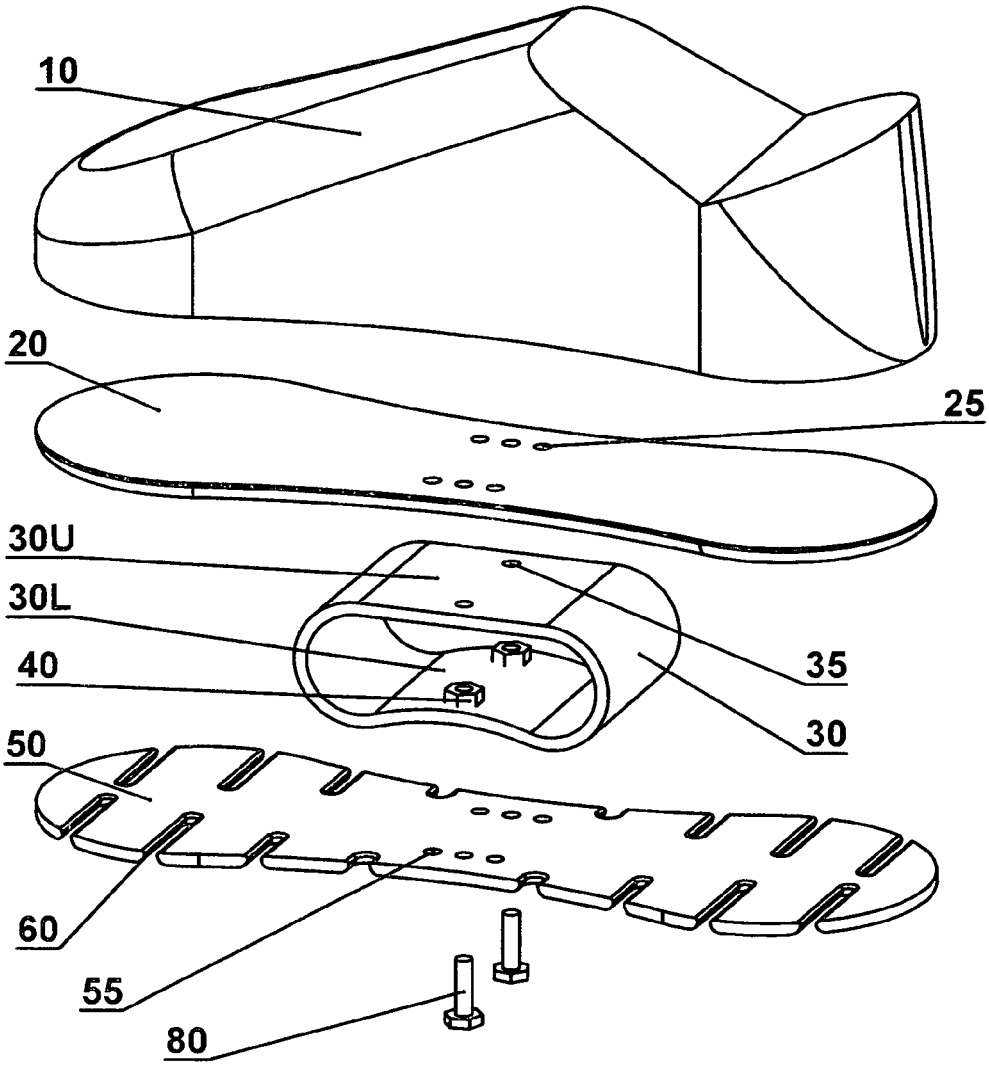
FIG. 1 shows an exploded perspective view of the adjustable spring device for walking and running, according to a preferred embodiment of the present invention.

FIG. 1 shows an exploded perspective view of the inventive device attachable to footwear 10. In a preferred embodiment, the inventive device comprises: an upper sole 20 and a lower sole 50 placed below the upper sole 20. The upper sole 20 is made of predeterminedly stiff material that has minimum deformation upon applying an extreme load typically developed during the user's walking/running. The lower sole 50 is fabricated from a suitable high-tensile (high-strength) material with a predetermined elasticity, such as carbon fiber, or fiberglass, or a similar one. The soles 20 and 50 can be of various suitable shapes. In this embodiment they are configured in the form of plates, having a size approximately equal to the outline of normal footwear.

Figure 2:
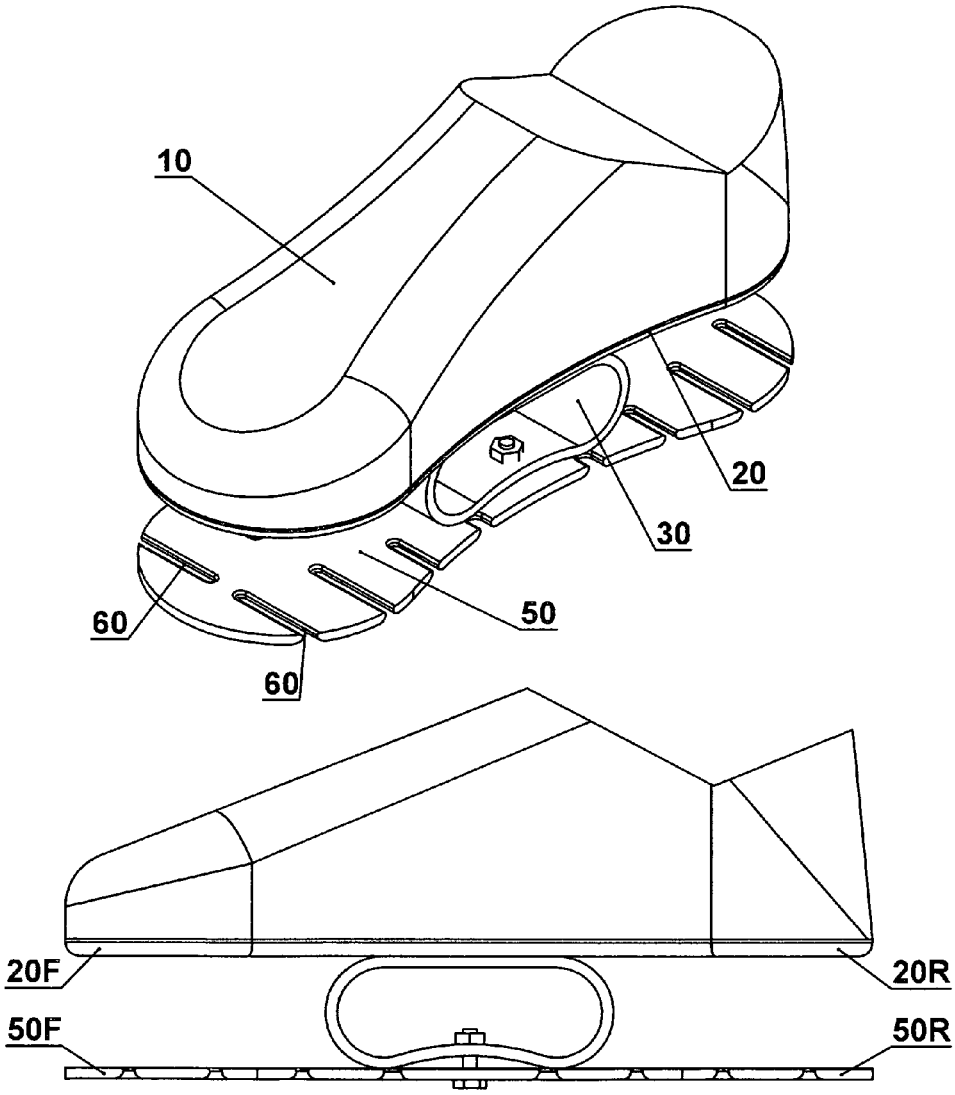
FIG. 2 shows a perspective view and a lateral projection view of the adjustable spring device without a bend of the lower sole, having a flat shape, according to the embodiment of present invention shown in FIG. 1.
Figure 3:
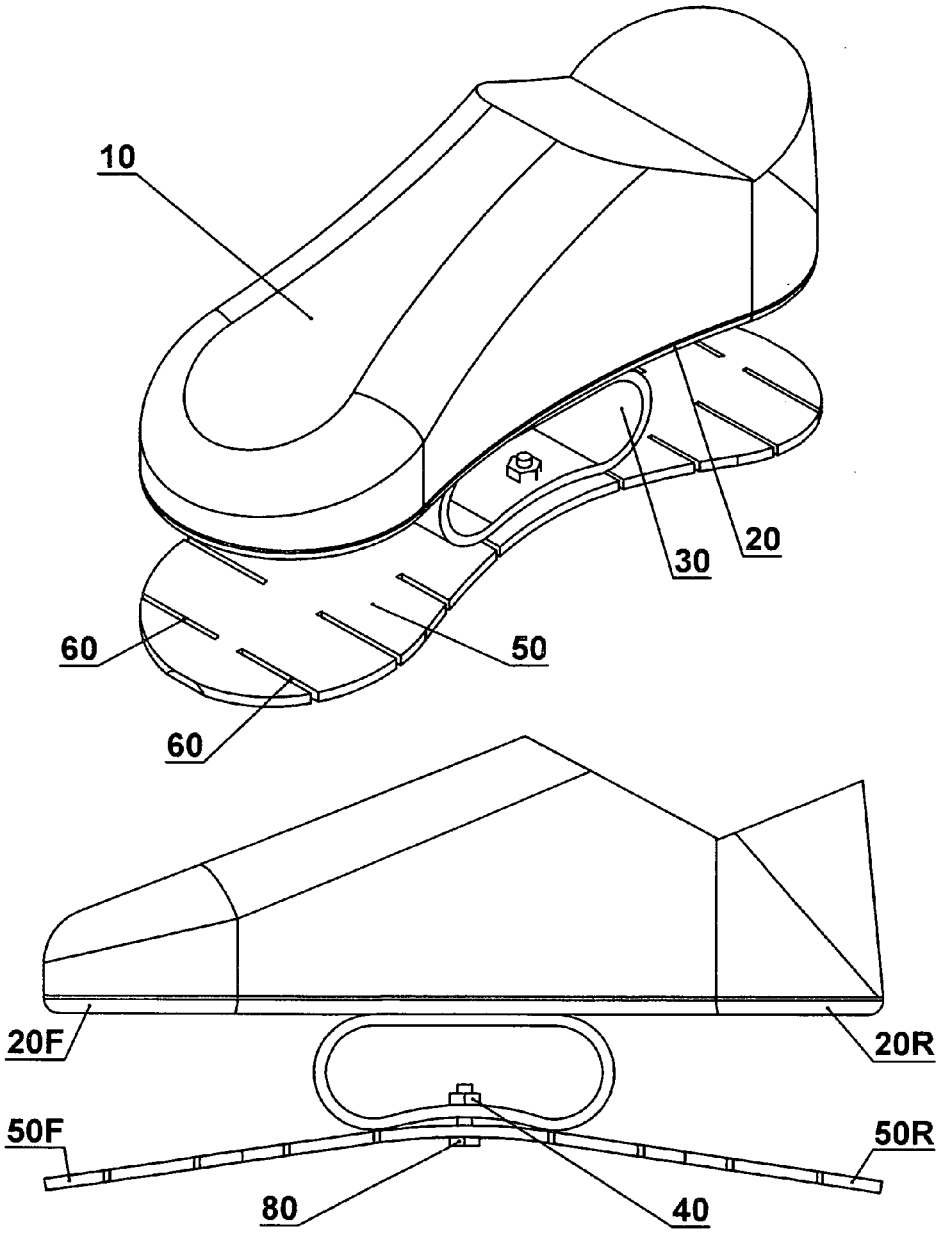
FIG. 3 shows a perspective view and a lateral projection view of the adjustable spring device wherein the lower sole is bent, having an arc-like shape, according to the embodiment of present invention shown in FIG. 1.
Figure 5:
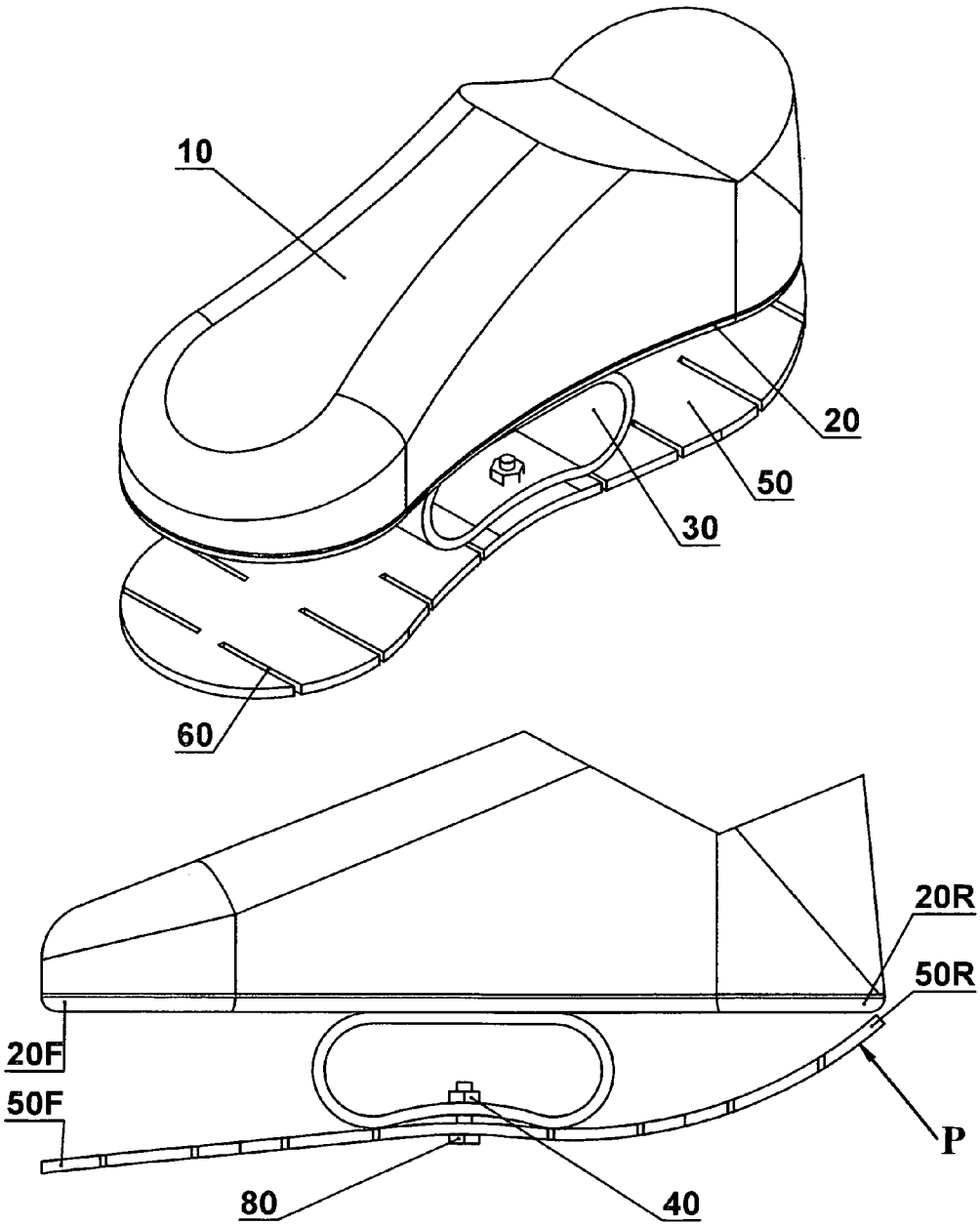
FIG. 5 shows a perspective view and a lateral projection view of the adjustable spring device having a lower sole supplied with a preferred number of slots, having specific locations and lengths, wherein a load P is applied to the rear part of the lower sole, according to the embodiment of present invention shown in FIG. 1.

The upper sole 20 has a front end 20F (herein also called an 'upper front end') and a rear end 20R (herein also called an 'upper rear end'), which ends are shown in FIGS. 2, 3 and 5. The upper sole 20 includes a plurality of orifices 25 preferably made in the middle region thereof.

The lower sole 50 has a front end 50F (herein also called a 'lower front end') and a rear end 50R (herein also called a 'lower rear end'), which ends are shown in FIGS. 2, 3 and 5. The lower sole 50 includes a plurality of orifices 55 preferably made in the middle region thereof.

Figure 4:
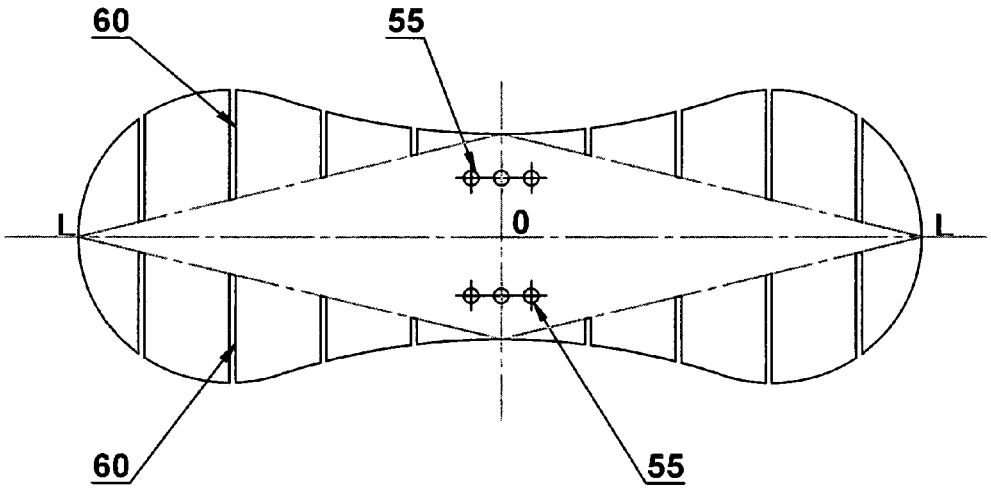
FIG. 4 shows a plan view of the lower sole, according to the embodiment of present invention shown in FIG. 1.

The lower sole 50 possesses a central longitudinal axis L-L and a central point O situated at the geometrical center of the axis L-L (see FIG. 4). As depicted on FIGS. 1-5, the lower sole 50 includes a periphery; a plurality of transverse slots 60 disposed perpendicular to the axis L-L (optionally, another predetermined angle can be used), wherein each such slot 60 is cut from the periphery towards the central longitudinal axis and ending at a predetermined point of the lower sole. Thusly, each slot 60 has a predetermined length and is located at a predetermined distance from the central point O.

As stated hereinabove, an optimal energy exchange condition can be established if the aforesaid slots 60 are arranged forming a special pattern, wherein the aforesaid predetermined points of the lower sole are so disposed that, if linked by four straight lines (shown in FIG. 4 as dotted lines) extending through the aforesaid predetermined points, the four straight lines form a rhomb-shaped figure having two vertexes essentially positioned on the periphery and on the central longitudinal axis L-L at the lower front end 50F and at the lower rear end 50R. This optimal energy exchange condition is illustrated in FIG. 5, wherein force P is applied to the lower rear end 50R, and a rear part of lower sole 50 is essentially bent as a circular arc due to the aforesaid arrangement of slots 60. Such circular arc bent creates favorable conditions for walking, which is discussed herein below.

As shown in FIG. 1, the support bracket 30 is preferably configured as a curvilined confined band with capable of approximating to a horizontally positioned '0'-like shaped figure. The support bracket has a flat top 30U (i.e. an upper portion of the support bracket 30), a concaved bottom 30L (i.e. a lower portion of the support bracket 30) slightly inwardly depressed (in the upward direction, as shown in FIGS. 1-3) in the middle region thereof, and arc-shaped sides joined with the flat top 30U and the concaved bottom 30L, and housing preferably two threaded nuts 40 inwardly attached to the concaved bottom 30L.

The flat top 30U is tightly fitted and fixedly fastened to the upper sole 20 by any known fastening means (e.g. pins inserted through the orifices 35 and 25, and secured in nuts integrated in the footwear 10; such nuts are not shown); whereas the concaved bottom 30L is fastened to the lower sole 50 preferably by means of bolts 80 (shown in FIG. 1) coupled with the corresponding threaded nuts 40 thereby fixing the support bracket 30 in a desirable position in relation to the front ends 20F and 50F, and the rear ends 20R and 50R. For the user's continence, such desirable position can be shifted by choosing an appropriate pair of orifices 55 of the lower sole. The support bracket 30 can also be shifted in relation to the upper sole 20 by choosing an appropriate pair of orifices 25 of the upper sole 20, imposing them on the orifices 35 of the flat top 30U, and coupling the support bracket 30 with the upper sole 20 in the desirable position, for example, by means of pins (not shown) inserted in the respective orifices 25 and 35.

OPERATION, ADJUSTMENT AND APPLICATIONS OF THE INVENTION

Operation of the inventive device in the support phase of locomotion is characterized with three stages: —a first contact with the ground, —a roll over from the heel to the toes, and—a push against the ground.

When a user puts his foot down on the ground (the first stage) with a heel, the rear end of lower sole 50R is bending by accumulating energy of the user's moving body. The distance between the rear end 20R of upper sole 20 and the rear end 50R of lower sole 50 determines a maximum amount of energy that can be absorbed at this stage.

During the second stage some energy returns to the user shoving him forward and the energy begins accumulating by bending the forward end 50F of lower sole 50.

FIG. 4 shows an example of the lower sole 50 with a particular number of slots 60, having specific locations and lengths. In this sample, the lower sole 50 has a bend, caused by the load force P, which bend is shaped as a circular arc (see FIG. 5). This circular arc shape (similar to a portion of a wheel) makes it easy to roll the foot in the second stage of support phase of locomotion. The distance between the upper forward end 20F and the lower forward end 50F determines a maximum amount of energy that can be absorbed at this stage.

Finally, at the third stage, the user pushes himself forward and up, and the energy accumulated during support phase returns to him. Thereby, the inventive device transforms a 'dangerous' energy of impact to a useful energy of movement.

Different users have different patterns of locomotion and different energy of moving. However, the device may operate efficiently in most of the cases, through an opportunity of adjusting.

Adjusting the inventive device can be provided in several ways as follows:

(1) The upper part 30U of the support bracket 30 can be attached to the upper sole 20 in a few positions of orifices 25 that allows varying the stiffness of the front (face) and rear (heel) parts of the device. The stiffness of the heel part increases and the stiffness of the face part decreases when the support bracket 30 is moved to the rear end 20R; and, vice versa, the stiffness of the heel part decreases and the stiffness of the face part increases when the support bracket 30 is shifted to the forward end 20F. Thereby, the user can choose a convenient distribution of stiffness along the footwear.

(2) The lower sole 50 can be attached to the lower concave part of support base 30*b* in few positions of orifices 55 that allows varying a stiffness of face and heel parts of device too.

(3) The fasten means such as bolts 80 and nuts 40 are used to adjust the device to the user's needs by bending the lower sole 50. The distances along the upper ends 20R and 20F and the lower ends 50R and 50F increase when the bend of the lower sole 50 increases (as shown in FIG. 3); and, vice versa, the distances along the upper ends 20R and 20F and the lower ends 50R and 50F decreases when the bend of the lower sole 50 decreases (as shown in FIG. 2). When the distances between the ends of the upper sole 20 and the lower sole 50 are changed, a capacity of the device to accumulate energy is changed as well. A more vigorous motion of the user requires absorbing more energy by the device, which necessitates a greater preliminary bend of the lower sole 50. The preliminary bend of the lower sole 50 can be regulated (adjusted) by tightening the bolts 80 and nuts 40.

(4) The lower sole 50 has slots 60. The number, location and length of the slots 60 determine the stiffness of the lower sole 50 and of the device as a whole. The lower soles 50 with the same size and shape can have a different stiffness due to a different number, location and length of slots 60. Therefore, the lower sole can be produced with rigidity in a desirable range.

(5) The user can have several interchangeable lower soles 50 with different stiffness and, possibly, with a different cover suitable for contact with a variety of ground surfaces.

Thusly, the users having several options for adjusting the inventive device can create a best condition of moving for themselves. The best condition is created by choosing a comfortable stiffness plus a suitable capacity of the device to accumulate the energy. The comfortable stiffness is achieved by making the lower sole with a specific number, location and length of the slots. The capacity of the device to accumulate energy is regulated by tightening the bolts and nuts. The stiffness can be regulated by tightening the bolts and nuts in a predetermined range as well.

Embodiments of this invention can be used for walking and running by people of all ages and as a simulator for rehabilitation after injury. It can also be used as part of robotic legs to recreate a human gait.

Some Important Points of the Invention are:

1) The stiffness of the device can vary by using a different number, location and length of the slots arranged on the lower sole.

2) By using a special number, location and length of the slots, the lower sole acquires a bent shape of a circular arc under the action of load. This shape makes it easy to roll the foot in the second stage of support phase of locomotion.

3) The users can have several interchangeable lower soles for different styles of moving and for a variety ground surfaces.

4) Tightening the bolts and nuts, which couple the support bracket with the soles, regulates the capacity of energy accumulation.

5) Tightening the bolts and nuts, which couple the support bracket with the soles, regulates the stiffness of the inventive device within a certain range.

I claim:

1. An adjustable spring device usable by a user for walking and running, said device is associated with the user's footwear, said device comprising:

an upper sole of a predetermined stiffness attached to or integrated into the footwear;

a lower sole of a predetermined elasticity, situated below the upper sole, the lower sole includes a central longitudinal axis, a periphery, a front end located on said central longitudinal axis and on said periphery at the very front point of said lower sole, and a rear end located on said central longitudinal axis and on said periphery at the very rear point of said lower sole;

a support bracket configured as a curvilinear confined band of a predetermined stiffness, the support bracket includes a flat top and a concaved bottom, wherein the flat top is fitted and fastened to a corresponding portion of the upper sole, whereas the concaved bottom is fastened to a corresponding portion of the lower sole such that said support bracket is fixed in relation to the upper sole, wherein the predetermined stiffness of the support bracket is chosen so that a position of said corresponding portion of the upper sole in relation to a position of said corresponding portion of the lower sole remains unchanged during the walking and running of the user, while the front end and the rear end are alternatively bent during the walking and running of the user;

wherein:

said lower sole is furnished with a plurality of slots, each said slot is cut from the periphery towards the central longitudinal axis and ending at a predetermined point of said lower sole;

the lower sole further defines a central transverse axis; and said predetermined points of the lower sole are disposed along four straight lines extending through the predetermined points, wherein the four straight lines form a figure having a shape of rhombus with two acute angle vertices positioned on the periphery and on the central longitudinal axis at the front end and at the rear end respectively, and two obtuse angle vertices positioned on the periphery and on the central transverse axis, thereby providing for bending of said lower sole in a shape of circular arc during the walking and running of the user.

* * * * *